US011898276B2

(12) United States Patent
Tsai et al.

(10) Patent No.: US 11,898,276 B2
(45) Date of Patent: Feb. 13, 2024

(54) CARBON FIBER AND METHOD OF FORMING THE SAME

(71) Applicant: FORMOSA PLASTICS CORPORATION, Kaohsiung (TW)

(72) Inventors: Kun-Yeh Tsai, Kaohsiung (TW); Chia-Chi Hung, Kaohsiung (TW); Wen-Ju Chou, Kaohsiung (TW); Ching-Wen Chen, Kaohsiung (TW); Chia-Chun Hsieh, Kaohsiung (TW); Shi-Jie Lin, Kaohsiung (TW); Long-Tyan Hwang, Kaohsiung (TW)

(73) Assignee: FORMOSA PLASTICS CORPORATION, Kaohsiung (TW)

( * ) Notice: Subject to any disclaimer, the term of this patent is extended or adjusted under 35 U.S.C. 154(b) by 0 days.

(21) Appl. No.: 17/827,565

(22) Filed: May 27, 2022

(65) Prior Publication Data

US 2022/0389624 A1 Dec. 8, 2022

(30) Foreign Application Priority Data

May 27, 2021 (TW) ..... 110119319

(51) Int. Cl.
*D01D 5/12* (2006.01)
*D01D 5/14* (2006.01)
(Continued)

(52) U.S. Cl.
CPC ..... *D01F 9/22* (2013.01); *D01D 5/06* (2013.01); *D02J 1/223* (2013.01); *D02J 1/228* (2013.01);
(Continued)

(58) Field of Classification Search
CPC .. D01D 5/06; D01D 5/12; D01D 5/14; D01D 10/02; D01F 9/22; D01F 9/225; D02J 1/22; D02J 1/223; D02J 1/228; D02J 13/00; D02J 13/005; D06B 1/00; D06B 3/04; D06M 15/643; D06M 15/6436; D06M 15/70; D06M 2101/28; D06M 2200/40
USPC ... 264/29.2, 29.7, 182, 210.7, 210.8, 211.14, 264/211.15, 211.17, 234; 423/447.1, 423/447.4, 447.8
See application file for complete search history.

(56) References Cited

U.S. PATENT DOCUMENTS 4,902,452 A * 2/1990 Nishihara ..... D01D 5/06 264/210.7
2012/0088104 A1* 4/2012 Hashimoto ..... D01F 9/22 264/29.2 X
2017/0284016 A1 10/2017 Aso et al.

FOREIGN PATENT DOCUMENTS

CN 102312300 A 1/2012
CN 105401444 A * 3/2016 ..... D06M 15/643
(Continued)

OTHER PUBLICATIONS

Translation of CN 105401444 A (published on Mar. 16, 2016).*
(Continued)

*Primary Examiner* — Leo B Tentoni
(74) *Attorney, Agent, or Firm* — MUNCY, GEISSLER, OLDS & LOWE, P.C.

(57) ABSTRACT

Carbon fiber and method of forming the same are provided. The method modifies proportion of a finishing oil to control a relation between a surface tension and a particle size of the finishing oil, and thus penetration of the finishing oil into an interior of the carbon fiber is avoided. Therefore, the carbon fiber can have both low oil residues and a high strength.

18 Claims, 1 Drawing Sheet

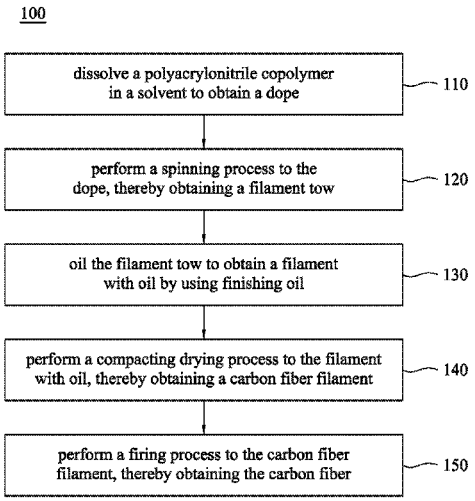

(51) Int. Cl.

| | |
|---|---|
| ***D01D 10/02*** | (2006.01) |
| ***D02J 1/22*** | (2006.01) |
| ***D02J 13/00*** | (2006.01) |
| ***D06B 1/00*** | (2006.01) |
| ***D06B 3/04*** | (2006.01) |
| ***D06M 15/643*** | (2006.01) |
| ***D06M 15/70*** | (2006.01) |
| ***D01F 9/22*** | (2006.01) |
| ***D01D 5/06*** | (2006.01) |
| *D06M 101/28* | (2006.01) |

(52) U.S. Cl.
CPC ..... *D02J 13/005* (2013.01); *D06M 15/6436* (2013.01); *D06M 2101/28* (2013.01); *D06M 2200/40* (2013.01); *D10B 2101/12* (2013.01)

(56) References Cited

FOREIGN PATENT DOCUMENTS

| | | | | | |
|---|---|---|---|---|---|
| CN | 107075789 | A | | 8/2017 | |
| CN | 111088559 | A | | 5/2020 | |
| CN | 111501137 | A | | 8/2020 | |
| JP | 11117128 | A | * | 4/1999 | ..... D01F 9/12 |
| JP | H11-241230 | A | | 9/1999 | |
| JP | 2002146681 | A | * | 5/2002 | ..... D01F 9/22 |
| JP | 2002317335 | A | | 10/2002 | |
| JP | 2005264361 | A | | 9/2005 | |
| JP | 2015030943 | A | | 2/2015 | |
| JP | 2016-17231 | A | | 2/2016 | |
| JP | 2016199824 | A | * | 12/2016 | ..... D01F 9/22 |
| TW | 200535287 | A | | 11/2015 | |

OTHER PUBLICATIONS

Translation of JP 11117128 A (published on Apr. 27, 1999).*
Translation of JP 2002146681 A (published on May 22, 2002).*
Translation of JP 2016199824 A (published on Dec. 1, 2016).*
Isao Mochida et al., "The Role of Oiling Agent in the Manufacture of Petroleum Mesophase Pitch Based Carbon Fiber and Its Improvement", Sekiyu Gakkaishi, vol. 36, No. 1, 1993.
Hiromi Aso and Toru Kannabe, "Polyacrylonitrile-based carbon fiber", Tanso, 2007 (No. 227), pp. 115-121. with its English translation.

* cited by examiner

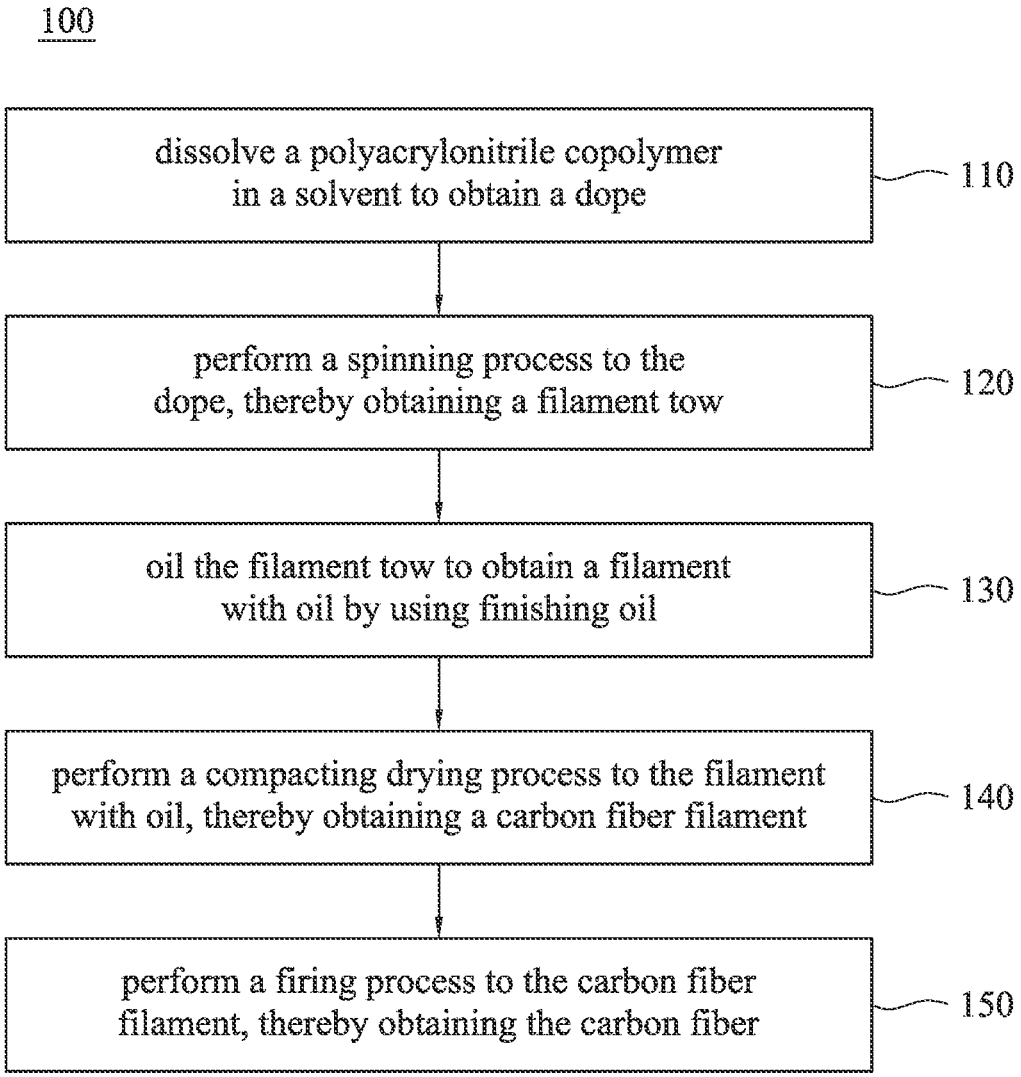
100
dissolve a polyacrylonitrile copolymer in a solvent to obtain a dope
110
perform a spinning process to the dope, thereby obtaining a filament tow
120
oil the filament tow to obtain a filament with oil by using finishing oil
130
perform a compacting drying process to the filament with oil, thereby obtaining a carbon fiber filament
140
perform a firing process to the carbon fiber filament, thereby obtaining the carbon fiber
150

CARBON FIBER AND METHOD OF FORMING THE SAME

CROSS-REFERENCE TO RELATED APPLICATION

This application claims priority to Taiwan Application Serial Number 110119319, filed May 27, 2021, which is herein incorporated by reference.

BACKGROUND

Field of Invention

The present invention relates to a method of forming a carbon fiber. More particularly, the present invention relates to a carbon fiber with a high strength and a method of forming the same.

Description of Related Art

A carbon fiber has properties of low density, great resistance to acid and alkali corrosion, conductivity, not easy to thermal expansion and contraction and great mechanical property. Therefore, the carbon fiber is widely applied in aerospace industry, high pressure gas cylinder, wind drive generator blades, automotive industry, cable core, reinforcement, sports equipment, military industry, and medical device. In recent years, demand of high pressure gas cylinder used in fuel cell vehicle increases rapidly with rise of environmental awareness, and requirement of the carbon fiber with high strength also significantly increases. Current target is increasing loading of hydrogen and decreasing weight of vehicle body by increasing bursting strength of gas cylinder, thereby increasing endurance of fuel cell vehicle.

The carbon fiber can be divided into polyacrylonitrile (PAN), rayon, pitch and etc. according to material of filament. Conventional method of forming the carbon fiber is that after performing a spinning process to the above material to spin to a filament yarn, stabilization treatments such as an oxidation treatment and a cyclization treatment are performed at a temperature of 200° C. to 300° C. Then, in a condition of inert gas (such as nitrogen, argon and helium), a carbonization reaction such as high temperature firing process is performed to get rid of non-carbon element such as nitrogen, hydrogen and oxygen, and thus product of the carbon fiber is produced.

However, during the above stabilization treatment and high temperature carbonization reaction, the polymer may be melted by heat, resulting in problems such as fused together between single fibers of a filament tow or direct combustion of filament yarn. Further, the produced carbon fiber has defects of hairiness or breaks. When manufacturing carbon fiber composites in the following process, the defects may result in problems such as nonuniform resin impregnation, decreasing in physical properties of the carbon fiber composites, and cosmetic defects. Therefore, in order to prevent the above problems, the filament yarn may be coated with a high temperature resistant finishing oil to improve during the spinning process of the filament yarn. Moreover, the finishing oil is selected to have resistance to high temperature greater than 200° C., thus polydimethylsiloxane (silicone oil) or modified silicone oil after ammonification, epoxy modification or esterification.

Before the stabilization treatments such as the oxidation treatment and the cyclization treatment of the filament yarn are completed, the silicone oil or modified silicone oil is attached to surface of the filament yarn, thus providing protection effect of thermal resistance of the filament yarn, and further fused together between single fibers or combustion can be avoided. However, if particles of the finishing oil penetrate to interior of the fiber, silicide such as silicon oxide ($SiO_x$), silicon carbide (SiC), silicon nitride ($Si_xN_y$) may be produced during the high temperature firing process. When such kinds of silicide remain in interior of the carbon fiber, bonding between carbon-carbon is impeded, thus unable to form graphite structure and resulting in structure defects, and further strength of the carbon fiber is decreased. In addition, the silicide as impurities of interior of the carbon fiber causes stress concentration while forcing the carbon fiber, thereby resulting in decreasing in physical properties of the carbon fiber. Moreover, hardness of the silicide is greater, such that abrasion occurs within the carbon fiber and expansion of the defect size, and the physical properties of the carbon fiber may further decrease.

According to above, it is needed to have a method of forming a carbon fiber, which can remain oil attachment rate of the filament and avoid the finishing oil remain in interior of the carbon fiber, thereby by avoiding defects such as fused together between single fibers and combustion, and the carbon fiber with high strength can be produced.

SUMMARY

An aspect of the present invention provides a method of forming a carbon fiber, which controls a relation between a surface tension and a particle size of finishing oil, thus decreasing the penetration of the finishing oil to interior of the carbon fiber, and the carbon fiber with a high strength can be obtained.

An another aspect of the present invention provides a carbon fiber, which is formed by the above aspect, and the carbon fiber can have both low amount of oil residue and a high strength.

According to the aspect of the present invention, a method of forming a carbon fiber is provided. The method includes dissolving a polyacrylonitrile copolymer in a solvent to obtain a dope. Subsequently, a spinning process is performed to the dope, thereby obtaining a filament tow. Then, the filament tow is oiled to obtain a filament with oil by using finishing oil. A surface tension (a) and a particle size (R) of the finishing oil satisfy following equation: $20<\sigma+(R/2)^{0.5}<60$. A compacting drying process is performed to the filament with oil, thereby obtaining a carbon fiber filament. Afterwards, a firing process is performed to the carbon fiber filament, thereby obtaining the carbon fiber.

According to an embodiment of the present invention, the polyacrylonitrile copolymer has a limiting viscosity in a range of 1.5 to 3.5.

According to an embodiment of the present invention, the filament tow has a pore diameter in a range of 20 nm to 140 nm.

According to an embodiment of the present invention, the finishing oil includes silicone oil, an emulsifier and water.

According to an embodiment of the present invention, the finishing oil has a particle size of 10 nm to 500 nm.

According to an embodiment of the present invention, the surface tension is in a range of 20 mN/m to 70 mN/m.

According to an embodiment of the present invention, the solvent includes dimethylformamide (DMF), dimethylacetamide, dimethyl sulfoxide (DMSO), zinc chloride, or sodium thiocyanate.

According to an embodiment of the present invention, the dope has a polymer concentration of 18 wt. % to 25 wt. %.

According to an embodiment of the present invention, before oiling the filament tow, the method further includes performing a drawing operation to the filament tow. The drawing operation has a draw ratio not greater than 5.

According to an embodiment of the present invention, a temperature of the compacting drying process is in a range of 100° C. to 200° C.

According to the another aspect of the present invention, a carbon fiber produced by the above aspect is provided.

According to an embodiment of the present invention, a residue of silicon within the carbon fiber is in a range of 500 ppm to 2500 ppm.

According to an embodiment of the present invention, a ratio of an amount of silicon within an interior of the carbon fiber to an amount of silicon on a surface of the carbon fiber is less than and equal to 0.7.

According to an embodiment of the present invention, a strength of the carbon fiber is greater than 5000 MPa.

According to the aspect of the present invention, a method of forming a carbon fiber is provided. The method includes performing a spinning process to a dope to obtain an as-spun fiber, in which the dope comprises a polyacrylonitrile copolymer. A first drawing operation is performed to the as-spun fiber to obtain a filament tow. The filament tow is oiled to obtain a filament with oil by using finishing oil. A surface tension (a) and a particle size (R) of the finishing oil satisfy following equation: $20<\sigma+(R/2)^{0.5}<60$. The surface tension is in a range of 20 mN/m to 70 mN/m, and the finishing oil has a particle size of 10 nm to 500 nm. A compacting drying process is performed to the filament with oil, thereby obtaining a first filament. A second drawing operation is performed to the first filament, thereby obtaining a second filament. A firing process is performed to the second filament, thereby obtaining the carbon fiber. The firing process includes a stabilization treatment and a carbonization treatment.

According to an embodiment of the present invention, the finishing oil includes a silicone oil, an emulsifier and water. Based on the finishing oil as 100 parts by weight, the silicone oil is 10 parts by weight to 60 parts by weight, the emulsifier is 10 parts by weight to 40 parts by weight, and the water is 30 parts by weight to 80 parts by weight.

According to an embodiment of the present invention, the first drawing operation is performed in a rinsing compartment, and a temperature of the rinsing compartment is greater than 70° C.

According to an embodiment of the present invention, a first draw ratio of the first drawing operation is less than 5, and a second draw ratio of the second drawing operation is not less than 2.

According to an embodiment of the present invention, the stabilization treatment is performed at a temperature of 200° C. to 300° C.

According to an embodiment of the present invention, a temperature of the carbonization treatment is greater than 1000° C.

With an application of the method of forming the carbon fiber and the produced carbon fiber, a relation between the surface tension and the particle size of the finishing oil is controlled, thus decreasing the penetration of the finishing oil to interior of the carbon fiber. As a result, the carbon fiber with both low oil residues and high strength can be produced.

It is to be understood that both the foregoing general description and the following detailed description are by examples, and are intended to provide further explanation of the invention as claimed.

BRIEF DESCRIPTION OF THE DRAWINGS

Aspects of the present disclosure are best understood from the following detailed description when read with the accompanying figures. It is noted that, in accordance with the standard practice in the industry, various features are not drawn to scale. In fact, the dimensions of the various features may be arbitrarily increased or reduced for clarity of discussion.

FIG. 1 illustrates a flow chart of the method of forming the carbon fiber according to some embodiments of the present invention.

DETAILED DESCRIPTION

As above, a method of forming the carbon fiber and the produced carbon fiber, a relation between a surface tension and a particle size of finishing oil is controlled, thus decreasing the penetration of the finishing oil to interior of the carbon fiber. As a result, the carbon fiber with both low oil residues and high strength can be produced.

Referring to FIG. 1, which illustrates a flow chart of a method 100 of forming the carbon fiber according to some embodiments of the present invention. First, operation 110 is performed to dissolve a polyacrylonitrile copolymer in a solvent to obtain a dope. In some embodiments, the polyacrylonitrile copolymer is formed by performing a copolymerization to a monomer solution mixed with acrylonitrile and 1 to 3 kinds of comonomers. In some embodiments, a concentration of the acrylonitrile is better greater or equal to 95 wt. %, and a total concentration of the comonomer is better less than 5 wt. %, so as to improve physical properties of the carbon fiber.

In some embodiments, the comonomers are monomers with unsaturated bonds, such as acrylic acid, methacrylic acid, acrylamide, methyl acrylate, ethyl acrylate, butyl acrylate, isobutyl acrylate, methyl methacrylate, ethyl methacrylate, isopropyl methacrylate, butyl methacrylate, isobutyl methacrylate, n-hexyl methacrylate, cyclohexyl methacrylate, itaconic acid, citric acid, maleic acid, methylfumaric acid, crotonic acid, 2-hydroxyethyl methacrylate, phenylethene, vinyl toluene, vinyl acetate, vinyl chloride, vinylidene chloride, ethylene bromide, vinyl fluoride, vinylidene fluoride, allyl sulfonate, styrene sulfonate, ammonium salt or ester derivatives of the aforementioned compound. In an example, in view of solubility of acrylonitrile copolymer in the solvent, consistency for the fiber, and functionality of contributing oxidation reaction during stabilization process, the comonomer prefers the itaconic acid.

In some embodiments, the polymerization reaction may be performed to the above monomer solution by solution polymerization, suspension polymerization or emulsion polymerization. Impurities, such as unreacted monomers, initiator residues and overreacted high polymers, of the polyacrylonitrile copolymer formed by the polymerization reaction should be removed. In some embodiments, based on extensibility of the carbon fiber filament and physical properties of the carbon fiber, the polyacrylonitrile copolymer has a limiting viscosity in a range of 1.5 to 3.5. It is understood that the limiting viscosity of the polyacrylonitrile copolymer depends on its molecular weight. When the limiting viscosity is in a range of 1.5 to 3.5, strength of the polymer is enough to be drawn with high draw ratio, thus obtaining the carbon fiber with high strength. Further, the polymer with viscosity in the above range has great solubility, so it may be not easy to cause breaks.

In some embodiments, the solvent used in operation 110 may be organic solvent such as dimethylformamide (DMF), dimethylacetamide, dimethyl sulfoxide (DMSO), or inorganic salts solution such as zinc chloride and sodium thiocyanate. In an example, based on dissolving power of the solvent, the preferred solvent is dimethyl sulfoxide, so as to avoid residue of metal affecting physical properties of the carbon fiber. In some embodiments, the dope has a polymer concentration in a range of 18 wt. % to 25 wt. %. If the polymer concentration is in the above range, the dope can bear high draw ratio, and the produced carbon fiber may have high strength. Further, the dope has better uniformity, suitable viscosity and flowability, and thus stability of the spinning process is good to produce the carbon fiber steadily.

Subsequently, operation 120 is performed to perform a spinning process to the dope, thereby obtaining a filament tow. The spinning process is a process that the dope is spitted out in a coagulation bath through a circle orifice of a spinning nozzle, thereby coagulating as the filament tow. In some embodiments, the spinning process may be dry-jet wet spinning or wet-jet wet spinning, which is selected according to further application of the carbon fiber. In some embodiments, a solvent included in the coagulation bath of the spinning process is the same as the solvent of the dope. A concentration of the solution in the coagulation bath depends on type of the solvent and the manufacturing process. In some embodiments, if the solvent is dimethyl sulfoxide, for example, the concentration of the solution is 20 wt. % to 50 wt. %. If the concentration of the solution is within the above range, rate of separation and coagulation of the polyacrylonitrile copolymer from the dope is relatively acceptable, and thus the filament tow may be spun completely, and may not cause the carbon fiber with loose structure. Further, size of surface porosity is suitable, and defects of fusing together between single fibers may not occur during the rinsing process and the drawing process. Generally, decreasing temperature of spinning process is advantage to improve consistency of the fiber. In some embodiments, the temperature of spinning process may be lower than 40° C.

Moreover, the filament tow may be selectively drawn with a draw ratio not greater than 5, and then the filament tow may be drawn again after replacing the solvent of rinsing compartment. It is noted that, generally, an as-spun fiber is obtained after the spinning process, while the filament tow or filament is referred to the as-spun fiber after drawing in the rinsing compartment. In some embodiments, the draw ratio in the rinsing compartments may be lower than 5, and it is better performed with multi-step drawing. In some embodiments, a bath solution of the rinsing compartment may be the same as the solvent of the coagulation bath. Typically, the rinsing temperature should be as high as possible in condition of not causing fuse together between the single fibers. In some embodiments, the temperature of the rinsing compartment is greater than 70° C., and greater than 90° C. is preferable. In order to avoid forming porosity due to residue of the solvent, it is more preferable of using boiling water as the bath solution. The aforementioned draw ratio, concentration and temperature of the bath solution in the rinsing compartment may be used to modify the size of the porosity of the fiber. In some embodiments, the filament tow after rinsing has a pore diameter in a range of 20 nm to 140 nm. The filament tow with the aforementioned pore diameter represents surface of the filament tow may not be too consistent or loose; therefore, the subsequent stabilization treatment may cause oxygen diffuse to interior of the fiber, thus making the carbon fiber with higher strength.

Subsequently, operation 130 is performed to oil the filament tow to obtain a filament with oil by using finishing oil. A surface tension (a) and a particle size (R) of the finishing oil have a relation in a specific range, as following equation (1):

$$20<\sigma+(R/2)^{0.5}<60 \quad (1)$$

When value of the equation (1) is smaller than 20, the oil residue in the carbon fiber may be too much, resulting in decreasing the strength of the carbon fiber. On the other hand, if value of the equation (1) is greater than 60, breaks may occur during manufacturing process, thus unable to steadily produce the carbon fiber. In some embodiments, the finishing oil includes silicone oil, water, and an emulsifier. In some embodiments, the silicone oil may be amino-modified silicone oil. The surface tension of the finishing oil may be modified by adjusting molecular weight and degree of ammonification of the silicone oil, or by adjusting concentration of the emulsifier or temperature of the finishing oil. In some embodiments, the surface tension of the finishing oil is 20 mN/m to 70 mN/m, and thus the finishing oil may diffuse to interior of the fiber with suitable amount. In some embodiments, if the amino-modified silicone oil is used, the emulsifier may be copolymer of poly(ethylene oxide) and poly(propylene oxide). For example, the silicone oil and the emulsifier are evenly dispersed in the water to form the finishing oil with well-distributed emulsion droplets by using a homogenizer. The particle size (R) of the finishing oil droplets may be modified by controlling mixing ratio of the amino-modified silicone oil and the emulsifier. Typically, when the proportion of the emulsifier is greater, the particle size of the finishing oil is smaller. In some embodiments, the particle size of the finishing oil is in a range of 10 nm to 500 nm. There's no need to adjust the particle size of the finishing oil corresponding to the pore diameter of the carbon fiber, and thus the finishing oil with the particle size range is easier to afford. For example, based on the finishing oil as 100 parts by weight, the silicone oil is 10 parts by weight to 60 parts by weight, the emulsifier is 10 parts by weight to 40 parts by weight, and the water is 30 parts by weight to 80 parts by weight.

Then, operation 140 is performed to perform a compacting drying process to the filament with oil, thereby obtaining a carbon fiber filament. Generally, the compacting drying process is performed by using a hot roller. Temperature of the compacting drying process is adjusted according to moisture content of the fiber. In some embodiments, the temperature is in a range of 100° C. to 200° C.

Next, after the compacting drying process, a second drawing process may be selectively performed. The second drawing process may use a hot roller with high temperature, a hot board with high temperature, or perform drawing in an environment with high-temperature and high-pressure steam. In some embodiments, the draw ratio of the second drawing process is greater or equal to 2.

Afterwards, operation 150 is performed to perform a firing process to the carbon fiber filament, thereby obtaining the carbon fiber. The firing process includes four steps which are a stabilization treatment, a carbonization treatment, a surface treatment and starching. The stabilization treatment is performed to control the carbon fiber filament with suitable tensile force in an air environment at 200° C. to 300° C. In some embodiments, density of the carbon fiber after the stabilization treatment is 1.30 g/cm$^3$ to 1.40 g/cm$^3$. Subsequently, the carbon fiber is located in an inert environment to perform a high temperature carbonization. In some embodiments, temperature of the carbonization treatment is greater than 1000° C., and greater than 2000° C. is preferable. Then, the surface treatment is performed to the carbon fiber, thereby increasing binding ability between the carbon fiber and resin. In some embodiments, the surface treatment includes a chemical grafting, a plasma treatment, an electrolytic treatment, an ozone treatment, and etc. Afterwards, after rinsing and drying the carbon fiber with the surface treatment, the starching is performed by using impregnation method. The starching step may provide the carbon fiber with protective effects such as abrasion resistance and strand integrity.

In some embodiments, the carbon fiber produced by the method 100 may have strength greater than 5000 MPa. In some embodiments, a residue of silicon within the carbon fiber produced by the method 100 is in a range of 500 ppm to 2500 ppm, and 500 ppm to 2000 ppm is preferable. When the residue of silicon is in the above range, the filament has suitable oil attachment ratio, such that the finishing oil may have better protective effect such as abrasive resistance, thermal resistance and strand integrity to the carbon fiber, and the particles of the finishing oil may not easy to diffuse to interior of the fiber. Therefore, the defects such as hairiness and breaks may not tend to occur during the manufacturing process.

In some embodiments, a ratio of an amount of silicon within an interior of the carbon fiber to an amount of silicon on a surface of the carbon fiber is less than and equal to 0.7, less than and equal to 0.5 is preferable, and in a range of to 0.5 is more preferable. When the ratio of an internal amount of silicon to a surface amount of silicon of the carbon fiber is less than and equal to 0.7, there's no excess finishing oil diffusing from the surface of the fiber to the interior of the fiber, so the conventional defects of excess oil diffusion may be solved. It is noted that the interior of the carbon fiber means a depth of about 0.5 μm from the surface.

The following Embodiments are provided to better elucidate the practice of the present invention and should not be interpreted in anyway as to limit the scope of same. Those skilled in the art will recognize that various modifications may be made while not departing from the spirit and scope of the invention.

Embodiment 1

Dimethyl sulfoxide is used as a solvent. Acrylonitrile with a monomer concentration 98 wt. % and itaconic acid in 2 wt. % are used to perform solution polymerization reaction. Dope after the reaction has a polymer concentration of 22 wt. %. After the dope is spitted out from a spinning nozzle in an air environment, and a spinning process is performed in a coagulation bath to obtain a filament tow. Temperature of the coagulation bath is 3° C., and a bath solution is dimethyl sulfoxide in 35 wt. %. After rinsing the filament tow, the filament tow is drawn in two stages with a total draw ratio of 3.5 in boiling water. Then the filament tow is applied oil by using finishing oil in an oil bath, thereby obtaining a filament with oil, in which the finishing oil has a concentration of 1.5 wt. % and a temperature of 30° C. The finishing oil is composed of amino-modified silicone oil in 80 wt. % and a copolymer of poly(ethylene oxide) and poly(propylene oxide) in 20 wt. %, which are emulsified by a homogenizer. A compacting drying process is performed to the filament with oil by using a hot roller in a temperature of 175° C., and a drawing process with a draw ratio of 3.5 is performed in a high-temperature steam, thus obtaining a carbon fiber filament.

Temperature of the carbon fiber filament is increased from 240° C. to 280° C., and a rate ratio of front and back traction roller is controlled to be 1.0 to perform a stabilization treatment in a condition of remaining tension of the fiber. Density of the fiber after the stabilization treatment is 1.35 g/cm$^3$. Then, the temperature of the aforementioned fiber is gradually increased to 800° C., and the rate ratio of the front and the back traction roller is controlled to be 0.9 to perform a low-temperature carbonization process. After that, the temperature is gradually increased from 900° C. to 1800° C., and the rate ratio of the front and the back traction roller is controlled to be 0.95 to perform a high-temperature carbonization process. Then, the fiber is introduced to an acidic solution to perform an electrolysis surface treatment. After rinsing, drying, and starching, the carbon fiber of embodiment 1 is produced.

Embodiment 2 to 3 and Comparative Example 1 to 2

The concentration of the finishing oil in the oil bath is increased to 3.5 wt. %, while other process condition is the same as the embodiments 1, thereby obtaining the carbon fiber of embodiment 2.

The concentration of the solution in coagulation bath is decreased to 20 wt. %, and the temperature of the coagulation bath is increased to 15° C., while other process condition is the same as the embodiments 2, thereby obtaining the carbon fiber of embodiment 3.

The finishing oil composition is replaced by amino-modified silicone oil in 90 wt. % and a copolymer of poly(ethylene oxide) and poly(propylene oxide) in wt. %, while other process condition is the same as the embodiments 1, thereby obtaining the carbon fiber of comparative example 1.

The finishing oil composition is replaced by amino-modified silicone oil in wt. % and a copolymer of poly (ethylene oxide) and poly(propylene oxide) in wt. %, and the temperature of the oil bath is increased to 40° C., while other process condition is the same as the embodiments 1, thereby obtaining the carbon fiber of comparative example 2.

Evaluation Method

Pore Diameter of Fiber

The fiber sample without oiling after rinsing is dried at 90° C. for 2 hours, and then is measured by surface area and pore size distribution analyzer (BET) (3Flex Physisorption, Micromeritics). The measurement results are shown in table 1.

Particle Size of Finishing Oil

Dynamic light scattering (DLS) particle size analyzer (Brookhaven NanoBrook Omni) is used to measure the particle size of the finishing oil. The measurement results are shown in table 1.

Surface Tension of Finishing Oil

Surface tension meter (K100C, KRÜSS GmbH) is used to measure the surface tension of the finishing oil. The measurement results are shown in table 1.

Residue of Silicon within Carbon Fiber

After the carbon fiber is performed nitralising (dissolving in nitric acid), inductively coupled plasma optical emission spectrometry (ICP-OES) (Ultima2, Horiba) is used to measure residue of silicon within the carbon fiber. The measurement results are shown in table 1.

Silicon Impurity Amount Ratio of Interior to Exterior of Carbon Fiber (WS)

X-ray photoelectron spectrometer (XPS) (PHI VersaProbe III) is used to measure a surface amount of silicon (S). Then, ion gun etch is directly performed to the original sample, thereby measuring internal silicon amount (I) in a depth of 0.5 μm from the surface. Silicon impurity amount ratio of interior to exterior of the carbon fiber (I/S) is defined as a ratio of an amount of silicon within an interior of the carbon fiber (I) to an amount of silicon on a surface of the carbon fiber(S). The measurement results are shown in table 1.

Strength of Carbon Fiber

The measurement is performed according to ASTM D 4018-99 rule. The measurement results are shown in table 1.

TABLE 1

| | pore diameter (nm) | particle size of finishing oil (nm) | surface tension of finishing oil (mN/m) | $\sigma + (R/2)^{0.5}$ | residue of silicon(ppm) | I/S | strength of carbon fiber (Mpa) | condition of carbon fiber |
|---|---|---|---|---|---|---|---|---|
| Embodiment 1 | 28 | 30 | 72 | 36 | 453 | 0.47 | 5232 | Normal |
| Embodiment2 | 28 | 30 | 72 | 36 | 1211 | 0.37 | 5198 | Normal |
| Embodiment3 | 114 | 30 | 72 | 36 | 1349 | 0.42 | 5121 | Normal |
| Comparative example 1 | 28 | 50 | 582 | 67 | 322 | 0.18 | N/A | breaks |
| Comparative example 2 | 28 | 15 | 13 | 18 | 2641 | 0.87 | 3754 | Normal |

As shown in table 1, the finishing oils used in embodiment 1 to embodiment 3 have the particle size and surface tension in a relation meeting above equation (1), so the silicon residues of embodiment 1 to embodiment 3 are lower than 1400 ppm, silicon impurity amount ratios of interior to exterior are less than 0.7, even less than 0.5, and strength of the carbon fiber is above 5000 MPa. Moreover, for embodiment 3, the pore diameter of the fiber is far greater than the particle size of the finishing oil, but the I/S ratio shows that the finishing oil does not diffuse to interior in great amount. Comparative example 1 and comparative example 2 adjust composition proportion of the finishing oil, in which the particle size and surface tension of comparative example 1 are both increased, and a value calculated according to equation (1) is greater than 60. Therefore, although the silicon residue and the I/S ratio of comparative example 1 are both small, but many breaks occur during the manufacturing process, which means that it cannot produce steadily. On the other hand, the particle size and surface tension of comparative example 2 are both decreased, and the value calculated according to equation (1) is smaller than 20. The result is that comparative example 2 may produce normally, but the silicon residue and the I/S ratio both increase significantly, and strength of the carbon fiber is far smaller than 5000 MPa.

According to above embodiments, with an application of the method 100 of forming the carbon fiber and the produced carbon fiber, a relation between the surface tension and the particle size of the finishing oil is controlled, thus decreasing the penetration of the finishing oil to interior of the carbon fiber. As a result, the carbon fiber with both low oil residues and high strength can be produced.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims.

What is claimed is:

1. A method of forming a carbon fiber, comprising:

dissolving a polyacrylonitrile copolymer in a solvent to obtain a dope;

performing a spinning process to the dope, thereby obtaining a filament tow;

oiling the filament tow to obtain a filament with oil by using a finishing oil, wherein a surface tension (σ) is in a range of 30 mN/m to 70 mN/m, and the surface tension and a particle size (R) of the finishing oil satisfy following equation:

$$20<\sigma+(R/2)^{0.5}<60;$$

performing a compacting drying process to the filament with oil, thereby obtaining a filament; and performing a firing process to the filament, thereby obtaining the carbon fiber.

2. The method of claim 1, wherein the polyacrylonitrile copolymer has a limiting viscosity in a range of 1.5 to 3.5.

3. The method of claim 1, wherein the filament tow has a pore diameter in a range of 20 nm to 140 nm.

4. The method of claim 1, wherein the finishing oil includes a silicone oil, an emulsifier and water.

5. The method of claim 1, wherein the finishing oil has a particle size of 10 nm to 500 nm.

6. The method of claim 1, wherein the solvent includes dimethylformamide (DMF), dimethylacetamide, dimethyl sulfoxide (DMSO), zinc chloride, or sodium thiocyanate.

7. The method of claim 1, wherein the dope has a polymer concentration of 18 wt. % to 25 wt. %.

8. The method of claim 1, wherein before oiling the filament tow, the method further comprises:

performing a drawing operation to the filament tow, wherein the drawing operation has a draw ratio not greater than 5.

9. The method of claim 1, wherein a temperature of the compacting drying process is in a range of 100° C. to 200° C.

10. The method of claim 1, wherein a residue of silicon within the carbon fiber is in a range of 500 ppm to 2500 ppm.

11. The method of claim 1, wherein a ratio of an amount of silicon within an interior of the carbon fiber to an amount of silicon on a surface of the carbon fiber is less than or equal to 0.7.

12. The method of claim 1, wherein a strength of the carbon fiber is greater than 5000 MPa.

13. A method of forming a carbon fiber, comprising:

performing a spinning process to a dope to obtain an as-spun fiber, wherein the dope comprises a polyacrylonitrile copolymer;

performing a first drawing operation to the as-spun fiber to obtain a filament tow;

oiling the filament tow to obtain a filament with oil by using a finishing oil, wherein a surface tension (a) and a particle size (R) of the finishing oil satisfy following equation: $20<\sigma+(R/2)^{0.5}<60$, the surface tension is in a range of 30 mN/m to 70 mN/m, and the finishing oil has a particle size of 10 nm to 500 nm;

performing a compacting drying process to the filament with oil, thereby obtaining a first filament;

performing a second drawing operation to the first filament, thereby obtaining a second filament; and performing a firing process to the second filament, thereby obtaining the carbon fiber, wherein the firing process includes a stabilization treatment and a carbonization treatment.

14. The method of claim 13, wherein the finishing oil includes a silicone oil, an emulsifier and water, and based on the finishing oil as 100 parts by weight, the silicone oil is 10 parts by weight to 60 parts by weight, the emulsifier is 10 parts by weight to 40 parts by weight, and the water is 30 parts by weight to 80 parts by weight.

15. The method of claim 13, wherein the first drawing operation is performed in a rinsing compartment, and a temperature of the rinsing compartment is greater than 70° C.

16. The method of claim 13, wherein a first draw ratio of the first drawing operation is less than 5, and a second draw ratio of the second drawing operation is not less than 2.

17. The method of claim 13, wherein the stabilization treatment is performed at a temperature of 200° C. to 300° C.

18. The method of claim 13, wherein a temperature of the carbonization treatment is greater than 1000° C.

* * * * *